US007739968B2

(12) United States Patent
Borissov et al.

(10) Patent No.: US 7,739,968 B2
(45) Date of Patent: Jun. 22, 2010

(54) SYSTEM, APPARATUS AND METHOD FOR COMBUSTION OF METALS AND OTHER FUELS

(75) Inventors: Anatoli Borissov, Sugarland, TX (US); Alexander Borissov, Calgary (CA); Alexei Jirnov, Houston, TX (US); Michael Jirnov, legal representative, Houston, TX (US)

(73) Assignee: General Vortex Energy, Inc., Missouri City, TX (US)

( * ) Notice: Subject to any disclaimer, the term of this patent is extended or adjusted under 35 U.S.C. 154(b) by 441 days.

(21) Appl. No.: 11/828,188

(22) Filed: Jul. 25, 2007

(65) Prior Publication Data

US 2009/0126608 A1 May 21, 2009

Related U.S. Application Data

(60) Provisional application No. 60/883,175, filed on Jan. 3, 2007.

(51) Int. Cl.
*F23K 1/00* (2006.01)

(52) U.S. Cl. ..... 110/261; 110/232

(58) Field of Classification Search ..... None
See application file for complete search history.

(56) References Cited

U.S. PATENT DOCUMENTS 2,289,682 A * 7/1942 Raser ..... 122/33
2,997,006 A * 8/1961 Grosse ..... 110/341
3,267,891 A * 8/1966 Hemker ..... 110/232
3,606,866 A * 9/1971 Laessig et al ..... 122/4 R
3,966,428 A 6/1976 Rossi
3,991,559 A 11/1976 Oda et al.

(Continued)

FOREIGN PATENT DOCUMENTS

DE 2944863 A1 11/1979

OTHER PUBLICATIONS

Thompson, J.C.; Biodiesel Tech Notes:Characterization of Crude Glycerol from Biodiesel Production from Multiple Feedstocks. Applied Engr. Agri 22 (2): 261-265.

(Continued)

*Primary Examiner*—Kenneth B Rinehart
*Assistant Examiner*—David J Laux
(74) *Attorney, Agent, or Firm*—Bracewell & Giuliani LLP

(57) ABSTRACT

A system, apparatus and method for the combustion of metals and other fuels are provided. The system can include: a fuel combustion apparatus including a combustor having a combustion chamber for burning ground particles from a fuel charge, and a fuel supply apparatus for supplying the ground particles of fuel from the fuel charge to the combustor. The fuel supply system can include a fuel charge holder assembly to house and store the fuel charge, a grinder assembly including a grinder housed within the charge holder assembly and configured to pulverize the fuel charge to produce a combustible fuel to be consumed in the combustion chamber, and a fuel charge linear feed assembly including a piston in contact with the fuel charge within the charge holder assembly to selectively bias the fuel charge into the grinder to thereby a control consumption rate of the fuel charge. Exhaust from the combustion chamber can be used in the incineration of radioactive, chemical and mixed hazardous materials, and in the propulsion of a vehicle in both an air or water environment.

7 Claims, 7 Drawing Sheets

U.S. PATENT DOCUMENTS 4,015,063 A 3/1977 Basalay
4,019,319 A 4/1977 Oda et al.
4,032,303 A 6/1977 Dorer
4,175,047 A 11/1979 Schick
4,248,048 A * 2/1981 Smith, Jr. ..... 60/645
4,288,232 A 9/1981 Schmolka
4,477,383 A 10/1984 Beimesch
4,550,563 A 11/1985 Marchand
4,564,697 A 1/1986 Sutker
4,585,847 A 4/1986 Domeier
4,609,376 A 9/1986 Craig
4,617,026 A 10/1986 Shaub
4,683,069 A 7/1987 Bewster
4,690,783 A 9/1987 Johnson
4,780,229 A 10/1988 Mullin
4,879,052 A 11/1989 Mullin
4,920,691 A 5/1990 Fainman
5,131,921 A 7/1992 Sung
5,160,507 A 11/1992 Horodysky
5,194,068 A 3/1993 Mohr
5,211,721 A 5/1993 Sung
5,254,277 A 10/1993 Gentit
5,306,643 A 4/1994 Sadhir
5,399,729 A 3/1995 Cooper
5,405,418 A 4/1995 Ansarie
5,430,108 A 7/1995 Schlosberg
5,461,170 A 10/1995 Miyamoto
5,468,263 A 11/1995 Chung
5,502,247 A 3/1996 Bartos
5,512,313 A 4/1996 Cooper
5,516,341 A 5/1996 Farng
5,520,708 A 5/1996 Johnson
5,560,848 A 10/1996 Kim
5,645,234 A * 7/1997 Del Zotto ..... 241/101.76
5,656,040 A 8/1997 Cherpeck
5,665,686 A 9/1997 Schlosberg
5,677,379 A 10/1997 Becker
5,686,398 A 11/1997 Minokami
5,698,502 A 12/1997 Pafford
5,705,459 A 1/1998 Shiokawa
5,716,916 A 2/1998 Shiokawa
5,741,879 A 4/1998 McCormick
5,744,434 A 4/1998 Schlosbert
5,811,505 A 9/1998 McCormick
5,820,777 A 10/1998 Schnur
5,833,876 A 11/1998 Schnur
5,844,299 A 12/1998 Merrill
5,853,609 A 12/1998 Schnur
5,883,209 A 3/1999 Nakano
5,895,778 A 4/1999 McHenry
5,906,769 A 5/1999 Schnur
5,976,399 A 11/1999 Schnur
5,993,498 A 11/1999 Vrahopoulou
6,074,998 A 6/2000 He
6,087,464 A 7/2000 Swarup
6,183,662 B1 2/2001 Schnur
6,203,584 B1 3/2001 Fuentes-Afflick
6,221,272 B1 4/2001 Schnur
6,224,642 B1 5/2001 Daly
6,267,906 B1 7/2001 Schnur
6,280,488 B1 8/2001 Dillworth
6,296,782 B1 10/2001 Schnur
6,350,392 B1 2/2002 Schnur
6,361,711 B1 3/2002 Abe
6,402,983 B1 6/2002 Abe
6,419,941 B1 7/2002 Farone
6,444,626 B1 9/2002 McHenry et al.
6,465,642 B1 10/2002 Kenneally
6,468,319 B1 10/2002 Yeh
6,551,523 B1 4/2003 Schnur
6,551,524 B2 4/2003 Schnur
6,551,968 B2 4/2003 McHenry
6,605,452 B1 8/2003 Basheer
6,666,985 B2 12/2003 Schnur
6,755,046 B2 6/2004 Nishida
6,780,209 B1 8/2004 Filippini
6,787,600 B1 9/2004 Thetford
6,787,663 B2 9/2004 Adams
6,793,695 B2 9/2004 Wilkes
6,794,428 B2 9/2004 Burrington
6,800,154 B1 10/2004 Carey
6,802,874 B2 10/2004 Moreton
6,818,601 B1 11/2004 Lange
6,825,258 B2 11/2004 Steckel
6,827,749 B2 12/2004 Westfall
6,843,916 B2 1/2005 Burrington
6,846,782 B2 1/2005 Calder
6,846,783 B2 1/2005 Bartley
6,858,046 B2 2/2005 Daly
6,861,851 B2 3/2005 Lvovich
6,869,706 B2 3/2005 Varadaraj
6,872,693 B2 3/2005 Cain
6,881,780 B2 4/2005 Bryant
6,884,286 B2 4/2005 Thetford
6,884,761 B2 4/2005 Godici
6,890,364 B2 5/2005 Delfort
6,890,890 B2 5/2005 Gahagan
6,913,630 B2 7/2005 Filippini
6,929,707 B2 8/2005 Mullay
6,933,263 B2 8/2005 Manka
6,939,420 B2 9/2005 Pollack
6,949,235 B2 9/2005 Brown
6,949,236 B2 9/2005 Lal
6,951,589 B2 10/2005 Pollack
6,962,895 B2 11/2005 Scharf
6,983,614 B2 1/2006 Dick
7,008,988 B2 3/2006 Thetford
7,028,468 B2 4/2006 Brown
7,030,380 B2 4/2006 Boyle
7,044,988 B2 5/2006 Filippini
7,045,488 B2 5/2006 Bartley
7,045,580 B2 5/2006 Mullay
7,053,026 B2 5/2006 Li
7,067,594 B2 6/2006 Kolp
7,079,304 B2 7/2006 Kornbrekke
7,087,558 B2 8/2006 Detar
7,097,674 B2 8/2006 Delfort
7,116,467 B2 10/2006 Kornbrekke
7,154,016 B2 12/2006 Heller
7,176,174 B2 2/2007 Filippini
7,189,682 B2 3/2007 Gapinski
7,195,654 B2 3/2007 Jackson
D540,175 S 4/2007 Goodlive
7,208,022 B2 4/2007 Corkwell
7,208,098 B2 4/2007 Li

OTHER PUBLICATIONS

Borissov, Anatoli, et al.; High Temperature Aluminum Combustion for the Incineration of Hazardous Material; Proceedings of ICE2005, ASME Internal Combustion Engine Division, Spring Technological Conference, Chicago, Ill. Apr. 2005.

Unknown; Citric and Fatty Acid Esters of Glycerol; Prepared at the 35th Joint FAO/WHO Expert Committee on Food Additives, published in FNP 52 (1992).

Pachauri, Naresh, et al., Value-added Utilization of Crude Glycerol from Biodiesel Production: A Survey of Current Research Activities, 2006 American Society of Agricultural and Biological Engineers Annual International Meeting at Oregon Convention Center Jul. 9-12, 2006.

Argeros, Anastasios, et al.; Heat of Combustion of Oils, Apr. 30, 1998.

* cited by examiner

SYSTEM, APPARATUS AND METHOD FOR COMBUSTION OF METALS AND OTHER FUELS

RELATED APPLICATIONS

This non-provisional application claims priority to and the benefit of U.S. Patent Application No. 60/833,175, filed on Jul. 25, 2006, titled "System, Apparatus and Method for Combustion of Metals," incorporated herein by reference in its entirety.

BACKGROUND OF THE INVENTION

1. Field of the Invention

The present invention relates to the combustion of materials, specifically to the high temperature combustion of metals or other energetic fuel.

2. Description of Related Art

The incineration of radioactive, chemical and mixed hazardous materials requires high temperature combustors. In addition to high temperature, the incinerator needs to produce clean combustion. Aluminum, for example, is a very energetic metallic fuel and may produce an adiabatic reaction temperature of up to 10,600° C. when it reacts with oxygen. The combustion product, aluminum oxide, is a valuable product for many industrial applications. The exhaust gas from aluminum combustion, for example, is clean and does not contain any unburned hydrocarbons, nitric or carbon oxides, or volatile organic components as pollution from the combustion of hydrocarbons. The combustion of aluminum in a water phase environment has a high temperature exhaust stream of aluminum oxide in gaseous and solid phases and water vapor. The lack of pollution from an aluminum combustion process makes an aluminum combustor ideal for the incineration of hazardous materials. The ability to use air or water as the oxidizer for combustion is another very attractive feature of the combustion of aluminum. Aluminum fuel could be used in underwater incineration and also for the propulsion of various underwater mechanical devices such as torpedoes or submarines.

Aluminum reacts with oxygen exothermically following the reaction:

$$2Al(s)+3/2O_2 <-> Al_2O_3(g) \quad (A)$$

The calorimetric heat of reaction at 1 Bar is ($\Delta H°$ (298K)=−404 kcal/mol). There is, however, a problem with the direct burning of pure aluminum following this reaction. In an oxygen environment (e.g., air), a strong layer of $Al_2O_3$ coats an aluminum particle. The particle temperature must be raised past the $Al_2O_3$ melting point (2027° C.) to obtain ignition. The ignition delay time includes the time needed to heat, and then melt, the $Al_2O_3$ layer, plus the diffusion time for the $O_2$ to reach the aluminum surface and react. When Aluminum vaporizes, however, the kinetics is very rapid and no longer controls the ignition process. The sum of all these times is comparatively large, so particles escape with the high-speed gas flow from the combustion chamber without chemical reaction.

A reduction of the ignition delay time and a lowering of the ignition temperature, of aluminum is possible by oxidizing aluminum with steam in the following the reaction:

$$2Al(s)+3H_2O <-> Al_2O_3(g)+3H_2 \quad (B)$$

The calorimetric heat of reaction at 1 Bar is ($\Delta H°$(298K)=−230 kcal/mol). In a steam atmosphere, a hydroxide layer that is less protective than aluminum oxide covers the aluminum particles. According to reaction (B), the ignition temperature drops to 1323-1423° C. shortening the ignition time. This reaction is most attractive for underwater power generation and propulsion, since it does not require air. The oxidizer, seawater, is provided directly by the environment, dramatically reducing on-board storage requirements. The power density of reaction (B) is less than reaction (A) since the heat of reaction, for the same 2 moles of aluminum, is less for reaction (B).

Due to the high temperature of reaction (B), however, part of the water dissociates, resulting in a release of oxygen. This oxygen is used to burn the $H_2$ produced by reaction (B) in the following reaction:

$$3H_2+3/2O_2(g) <-> 3H_2O(g) \ (\Delta H° \ (298K) \text{ at 1 Bar}=-174 \text{ kcal/mol}). \quad (C)$$

Reactions (B) and (C) together produce the same energy release as (A) with less restrictive ignition constraints. Reaction (C) does not, however, need any external ignition source, since the $H_2$ produced in reaction (B) will be above its auto ignition temperature in an $O_2$ atmosphere.

Since the destruction of the aluminum oxide layer, by melting, is critical to aluminum combustion, the rapid heating of the particles is especially important. Heating can be produced by friction in a strongly turbulent stream flow or by convective/conductive heat transfer. In addition, sufficiently intensive friction (shear) forces or head-on collisions between particles could crack the oxide or hydroxide layer protecting the pure aluminum and ignite it. These have been the traditional mechanisms of heating aluminum prior to combustion. Through estimation of all above effects, Applicants have recognized that neither heating nor collisions effectively destroy the aluminum oxide layer. This indicates that combustor designs based on these mechanisms will not work efficiently.

Accordingly, recognized is the need for a combustion system including a fuel supply apparatus which can supply a metal fuel to a combustion apparatus having a relatively thin oxide layer and/or remove at least portions of the oxide layer immediately prior to consumption by the combustion apparatus without requiring a direct heating application. Also recognized is the need for a combustion system including a combustion apparatus capable of receiving such energetic metal fuel and to provide a highly efficient combustion of such energetic metal fuel that operate efficiently in either an air or water environment.

SUMMARY OF THE INVENTION

In view of the foregoing, embodiments of the present invention advantageously provide a system, apparatus, and methods of combusting materials. Embodiments of the present invention also advantageously provide a system, apparatus, and methods of combusting metal, specifically combusting aluminum, magnesium, or other energetic fuels. Embodiments of the present invention further advantageously provide a system, apparatus, and methods of providing such energetic metals for combustion from a charge cylinder.

Embodiments of the present invention advantageously overcome the difficulties of combusting metals such as aluminum. The invention uses a mechanical process to crack the strong aluminum oxide layer covering bare aluminum and provides a device and method for combusting aluminum fuel. Particularly, embodiments of the system can provide an aluminum fuel source including particles aluminum having a very thin layer of aluminum oxide surrounding each particle. At least portions of the aluminum oxide layer are fractured or stripped away by a fuel supply apparatus during grinding, and are immediately sent to a combustion apparatus where the exposed aluminum metal is quickly and nearly completely oxidized in the presence of ignition source, providing a significant heat source for burning other external materials, while forming a high-grade aluminum oxide byproduct that is nearly purely aluminum oxide, and/or alternatively or simultaneously providing a source of propulsion, depending upon the desired implementation.

Notably, embodiments of the present invention, however, could be used in the combustion of any metal or other high-energy solid fuel, which one skilled in the art would deem suitable for combustion. Although Aluminum provides unique properties advantageous in the incineration of hazardous materials and produces a commercially valuable exhaust product, this invention should not be limited to the combustion of only aluminum, but rather is envisioned in the combustion of any metal or energetic solid fuel.

More particularly, an embodiment of the present invention advantageously provides a system for the combustion of a metal. The system includes a combustor having a combustion chamber in which a metal fuel is combusted, and a fuel supply apparatus that communicates the metal fuel to the combustion chamber. The combustion chamber has an outer tubular member enclosing an inner tubular member in which the combustion of the metal fuel occurs. The combustion chamber also has an igniter positioned within the inner tubular member that ignites the metal fuel. The combustion chamber has a closed end with a metal fuel inlet extending therethrough and opening into an interior of the inner tubular member, and an open end defining a chamber exhaust through which combusted metal fuel exits the working chamber.

The system for the combustion of metal can also be configured so that the outer and inner tubular members define an annulus therebetween. The combustion chamber can also include a cooling fluid inlet extending through a sidewall of the outer tubular member. The combustion chamber can also include a cooling fluid outlet extending through a sidewall of the inner tubular member. The annulus carrying a cooling fluid from the cooling fluid inlet along an outer periphery of the inner tubular member to the cooling fluid outlet.

According to an embodiment of the fuel supply apparatus, the fuel supply apparatus includes a fuel charge holder assembly and a fuel charge feed assembly. The fuel charge holder assembly has a fuel charge holder body along with a pair of oppositely positioned flanges enclosing a metal fuel charge. The fuel charge holder assembly can enclose a grinder positioned to rotatably grind an end of the coma e.g., metal, fuel charge, and thereby generate particles of metal fuel from the fuel charge to be conveyed to the combustion chamber of the combustor. A carrier gas/fluid carries the particles of metal fuel to the metal fuel inlet. The carrier gas/fluid may be, for example, air, oxygen, water vapor, or combinations thereof. More preferably, the carrier gas/fluid is, instead, a neutral gas such as nitrogen, carbon dioxide, a noble gas, or combinations thereof. A piston and piston rod assembly biases the metal fuel charge toward the grinder so that the grinder continues to grind against an end of the fuel charge as the grinder rotates. The fuel charge feed assembly selectively actuates the piston and piston rod assembly within the fuel charge holder assembly.

According to an embodiment of the fuel charge feed assembly, the feed assembly has a feed motor and a feed shaft that is connected to the piston rod. The feed shaft is connected to a gear that translates rotational movement associated with the feed motor to linear movement of the feed shaft, such that when the feed motor is operating, the feed shaft actuates the piston rod and piston assembly to thereby bias the fuel charge toward the grinder. In an alternative embodiment, the piston rod is housed entirely within the fuel charge holder assembly negating the need for a separate feed shaft.

The system for the combustion of metal can also be configured so that the grinder has a mill fixedly secured to a grinder shaft that is rotated by a grinder motor. The mill can have a blade positioned thereon for engaging the metal fuel charge as the mill rotates. The system for the combustion of metal can also be configured so that the charge holder body has a tubular housing with a first flange closing a first end adjacent the grinder motor, and a second flange closing a second end adjacent the fuel charge feed assembly. The grinder shaft can extend from the mill through the first flange to connect to the grinder motor A first plurality of seals can be positioned on the first flange to sealingly engage an outer periphery of the grinder shaft so that the carrier gas/fluid and the particles of metal fuel do not communicate to the grinder motor. The piston rod can extend from the piston through the second flange to connect to the feed shaft. A second plurality of seals can be positioned on the second flange to sealingly engage an outer periphery of the piston rod. In an alternative embodiment, configured so that the piston rod is housed entirely within the fuel charge holder assembly, the grinder driveshaft extends from the grinder motor to the grinder through a pathway extending through the piston rod and/or a piston rod extension.

The system for the combustion of metal can also be configured so that the fuel charge feed assembly includes a pin extending from the feed shaft, and a limit switch positioned so that the pin engages the limit switch when the feed shaft is in a predetermined location. The limit switch is in electrical communication with the feed motor so that the limit switch causes the feed motor to cease operating when the pin engages the limit switch. The feed motor can be a variable speed motor that can rotate in a first direction that causes the feed shaft to push the piston and piston rod assembly toward the grinder, and a second direction that causes the feed shaft to pull the piston and piston rod assembly away from the grinder. The limit switch can be a pair of spaced-apart switches. One of the pair of switches can be positioned to engage the pin when the piston is adjacent the grinder. The other of the pair of switches can be positioned to engage the pin when the piston is in position for the fuel charge holder assembly to receive the metal fuel charge. The pair of switches thereby reducing damage to the fuel charge holder assembly due to the feed motor over-driving the feed shaft in when pushing and pulling the piston rod assembly.

According to an embodiment of the present invention, the fuel supply apparatus for supplying a metal fuel to a combustion chamber includes a fuel charge holder assembly and a fuel charge feed assembly. The fuel charge holder assembly has a charge holder enclosing a metal fuel charge. The fuel charge holder assembly encloses a grinder positioned to rotatably grind an end of the metal fuel charge, and thereby create particles of metal fuel to be conveyed to the combustion chamber. The fuel charge holder assembly receives a carrier gas/fluid that is adapted to carry the particles of metal fuel to the combustion chamber. The carrier gas/fluid may be, for example, air, oxygen, water vapor, or combinations thereof. More preferably, the carrier gas/fluid is a neutral gas such as nitrogen, carbon dioxide, a noble gas, or combinations thereof. The fuel charge holder assembly also has a piston and piston rod assembly that biases the metal fuel charge toward the grinder so that the grinder continues to grind against an end of the fuel charge as the grinder rotates. The fuel charge feed assembly selectively actuates the piston and piston rod assembly of the fuel charge holder assembly. The feed assembly has a feed motor and a feed shaft that is connected to the piston rod. The feed shaft is connected to a gear that translates rotational movement associated with the feed motor to linear movement of the feed shaft such that when the feed motor is operating, the feed shaft actuates the piston rod and piston assembly to thereby bias the fuel charge toward the grinder. The fuel supply apparatus can be configured so that the grinder has a mill fixedly secured to a grinder shaft that is rotated by a grinder motor. The mill can have a blade positioned thereon for engaging the metal fuel charge as the mill rotates.

The fuel supply apparatus can be configured so that the charge holder has a tubular housing with a first flange closing a first end adjacent the grinder motor, and a second flange closing a second end adjacent the fuel charge feed assembly. The fuel supply apparatus can also include that the grinder shaft extends from the mill through the first flange to connect to the grinder motor. A first plurality of seals can be positioned on the first flange to sealingly engage an outer periphery of the grinder shaft so that the carrier gas/fluid and the particles of metal fuel do not communicate to the grinder motor. The fuel supply apparatus can include that the piston rod extends from the piston through the second flange to connect to the feed shaft. A second plurality of seals can be positioned on the second flange to sealingly engage an outer periphery of the piston rod.

The fuel supply apparatus can be configured so that the fuel charge feed assembly also has a pin extending from the feed shaft and a limit switch. The limit switch can be positioned so that the pin engages the limit switch when the feed shaft is in a predetermined location. The limit switch can be in electrical communication with the feed motor so that the limit switch causes the feed motor to cease operating when the pin engages the limit switch. The feed motor can be a variable speed motor that can rotate in a first direction that causes the feed shaft to push the piston and piston rod assembly toward the grinder, and a second direction that causes the feed shaft to pull the piston and piston rod assembly away from the grinder. The limit switch can include a pair of spaced-apart switches. One of the pair of switches can be positioned to engage the pin when the piston is adjacent the grinder. The other of the pair of switches can be positioned to engage the pin when the piston is adjacent the second flange and is in position for the fuel charge holder assembly to receive the metal fuel charge. The limit pin and switches thereby reducing damage to the fuel charge holder assembly due to the feed motor over-driving the feed shaft, when pushing and pulling the piston rod assembly.

An embodiment of the present invention also advantageously provides a fuel charge holder assembly that prepares metal fuel for conveyance to a combustion chamber. The fuel charge holding assembly includes a charge holder enclosing a metal fuel charge. A grinder is positioned to rotatably grind an end of the metal fuel charge and thereby create particles of metal fuel to be conveyed to the combustion chamber. A carrier gas/fluid is adapted to carry the particles of metal fuel to the combustion chamber. The carrier gas/fluid may be, for example, air, oxygen, water vapor, or combinations thereof. More preferably, the carrier gas/fluid is a neutral gas such as nitrogen, carbon dioxide, a noble gas, or combinations thereof. A piston and piston rod assembly biases the metal fuel charge toward the grinder, so that the grinder continues to grind against an end of the fuel charge as the grinder rotates.

The fuel charge holder can include that the grinder has a mill fixedly secured to a grinder shaft that is rotated by a grinder motor. The mill can have a blade positioned thereon for engaging the metal fuel charge as the mill rotates. The charge holder can also have a tubular housing with a first flange closing a first end adjacent the grinder motor, and a second flange closing a second end adjacent the piston and piston rod assembly. The grinder shaft can extend from the mill through the first flange to connect to the grinder motor. A first plurality of seals can be positioned on the first flange to sealingly engage an outer periphery of the grinder shaft so that the carrier gas/fluid and the particles of metal fuel do not communicate to the grinder motor. The piston rod can extend from the piston through the second flange. A second plurality of seals can be positioned on the second flange to sealingly engage an outer periphery of the piston rod.

Embodiments of the present invention also provide a method for combusting an, e.g., metal fuel source comprising a fuel charge. For example, according to an embodiment of a method, the method can include the steps of introducing a metal charge into a metal fuel charge holder assembly biased in direct contact with a mechanical grinding device, initiating the mechanical grinding device to pulverize the metal charge within the metal fuel charge holder assembly and create a metal combustible fuel, providing a carrier gas/fluid to carry the metal combustible fuel from the mechanical grinding device to a combustion chamber of a combustor, both introducing an oxygenated cooling fluid into the combustion chamber, introducing the metal combustible fuel carried by the carrier gas/fluid into the combustion chamber adjacent an ignitor, e.g., burning a non-metal combustible fuel, and mixing the oxygenated cooling fluid with the metal combustible fuel, to create a combustible fuel mixture including the metal combustible fuel and to initiate a metal combustion reaction with the combustible fuel mixture to thereby generate a combusted working fluid. The method also includes a step of sustaining the metal combustion reaction by continued positioning of the metal charge in direct contact with the mechanical grinding device and by continued pulverization of the metal charge until the metal charge has been consumed.

BRIEF DESCRIPTION OF THE DRAWINGS

So that the manner in which the features and advantages of the invention, as well as others which will become apparent, may be understood in more detail, a more particular description of the invention briefly summarized above may be had by reference to the embodiments thereof which are illustrated in the appended drawings, which form a part of this specification. It is to be noted, however, that the drawings illustrate only various embodiments of the invention and are therefore not to be considered limiting of the invention's scope as it may include other effective embodiments as well.

DETAILED DESCRIPTION

Figure 1:
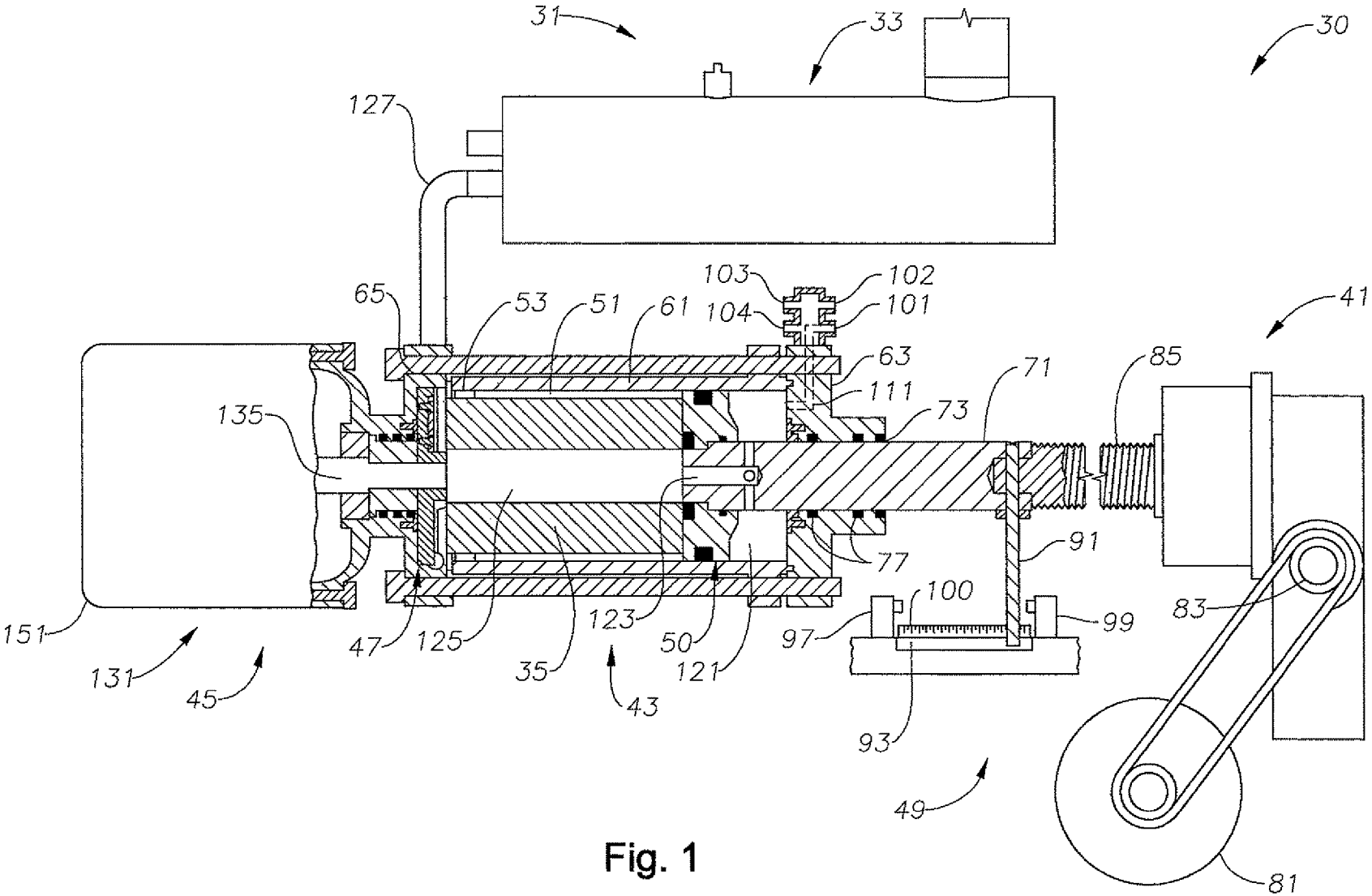
FIG. 1 is a schematic sectional view of a system for combustion of a fuel including a fuel supply apparatus and a combustion apparatus according to an embodiment of the present invention.
Figure 2:
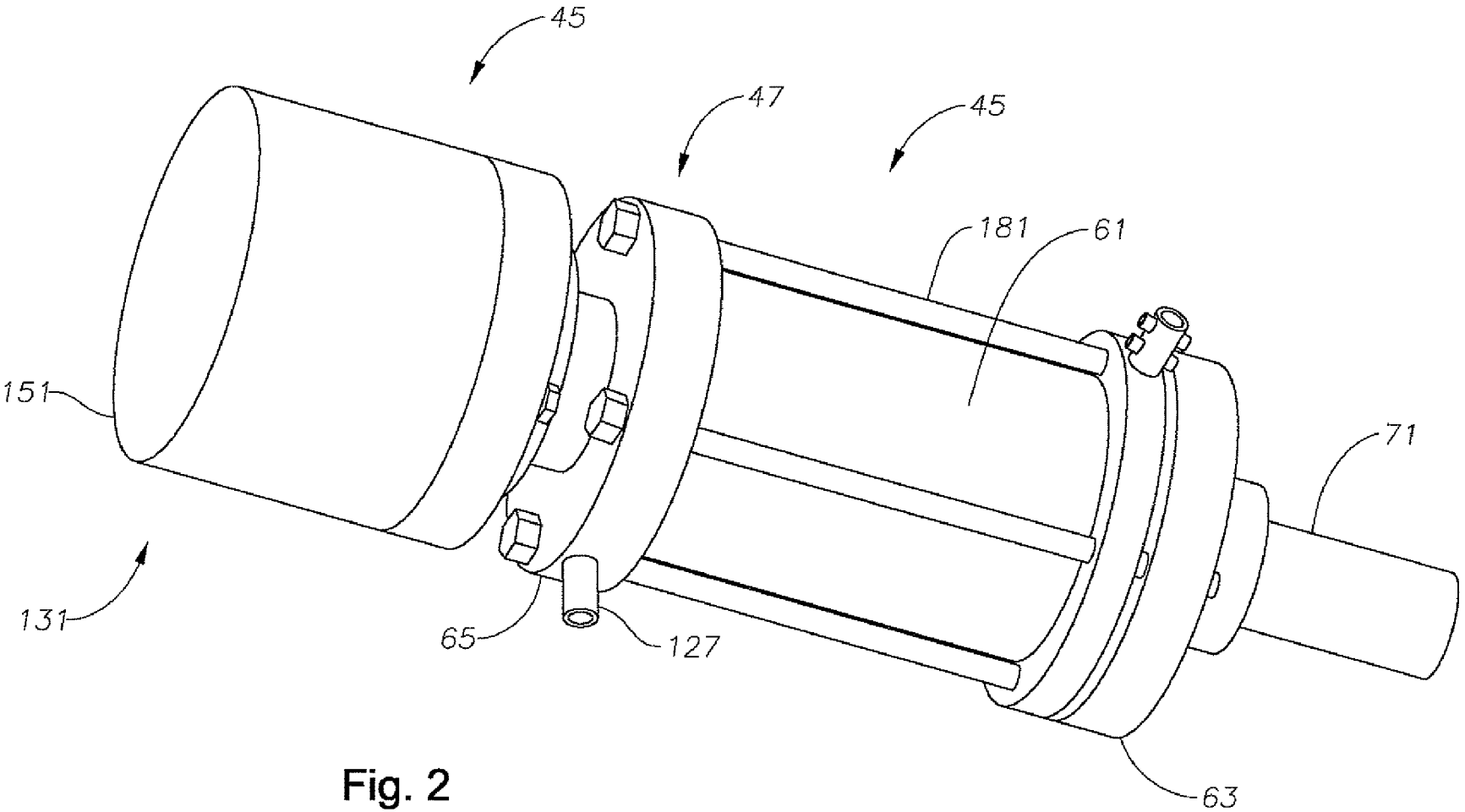
FIG. 2 is a perspective view of the fuel supply apparatus shown in FIG. 1 according to an embodiment of the present invention.

The present invention will now be described more fully hereinafter with reference to the accompanying drawings, which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art.

FIGS. 1-8 illustrate a system 30 for burning a high-energy fuel. The system 30 includes two major components: a fuel combustion apparatus 31 including a combustor 33 for burning ground particles from a fuel charge 35; and a fuel supply apparatus 41 for supplying fuel to the combustor 33, which includes a fuel charge holder assembly 43 to house and store fuel charge 35, a grinder assembly 45 including a grinder 47 typically housed within the charge holder assembly 43 and configured to grind the fuel charge 35, and a fuel charge linear feed assembly 49 including a piston 50 in contact with the fuel charge 35 within the charge holder assembly 43 to selectively bias the fuel charge 35 into the grinder 47.

More specifically, as illustrated in FIGS. 1-5, a fuel supply apparatus 41 stores and crushes an, e.g., metal, fuel charge 35 for supplying fuel to a fuel combustion apparatus 31. As perhaps best shown in FIG. 1, in an embodiment of the fuel supply apparatus 41, the supply apparatus 41 includes a charge holder assembly 43 which houses a grinder assembly 45 including a grinder 47 which crushes or grinds/pulverizes the fuel charge 35 at a desired rate, and to a desired particle size. The fuel charge 35, generally formed of compressed metal particles, is used as combustible fuel. In an embodiment of the fuel charge 35, the fuel charge 35 is pre-pressed metallic particles formed into a barrel shape with an axial length of about 150 mm, an outer diameter of, e.g., about 100 mm, and includes an inner bore having an inner diameter of, e.g., about 30 mm to either provide a working fluid conduit or to provide a driveshaft passageway, as described in more detail later. In an embodiment of the fuel charge 35, the fuel charge 35 can also have one or more axially oriented lock grooves 51 along the external edge of the fuel charge 35 (8×5 mm) which, in combination with one or more lock pins 53 positioned within the lock grooves 51, function to prevent rotation of the fuel charge 35 within an, e.g., annular shaped, charge holder body 61 of the charge holder assembly 43. Note, according to a preferred configuration, the fuel charge 35 has between a 1:1 to 1.5:1 length-diameter ratio. Although alternative length-diameter ratios are within the scope of the present invention, when longer, e.g., metal, fuel charges are to be built, considerable scatter of the volume content of solid metal fuel particles is likely to occur along the length of the fuel charge.

As perhaps best shown in FIG. 1, and as identified above, the fuel charge 35 is arranged within the charge holder assembly 43 of supply apparatus 41. According to an embodiment of the charge holder assembly 43, the charge holder assembly 43 includes an elongate fuel charge holder body 61, for example, in the form of a cylinder/tube, axially bounded on either end by a pair of axially oppositely positioned flanges 63, 65, positioned to enclose the charge holder body 61 to thereby contain the fuel charge 35. In the illustrated embodiments, the charge holder body 61 has a substantially tubular shape with an inner diameter of, e.g., 100 mm, and a length of; e.g., 175 mm, to accommodate one or more fuel charges 35 and a supply apparatus piston 50, described in more detail later. The charge holder body 61 can also have a wall width of; e.g., 7 mm, to ensure sufficient safety in operating the unit at working fluid pressures of up to approximately 4 MPa.

The length of the working zone of the charge holder body 61 can equal, e.g., about 150 mm, to accommodate, for example, a fuel charge 35 having up to approximately 1200 grams of magnesium and/or aluminum with, e.g., approximately a 60%-70% particle volume content, and having a diameter of up to, e.g., approximately 100 mm, and an axial length of up to, e.g., approximately 150 mm. In the exemplary embodiment of the charge holder body 61, the charge holder body 61 is rated for a working fluid pressure of 12 MPa.

Note, although illustrated in the form of a circular (annular) cylinder, the fuel charge 35 and the charge holder body 61 can each have other geometric shapes such as, for example, that of a triangle, a star, a square, or others known to those skilled in the art. Note also, although described as including magnesium and/or aluminum, the fuel charge 35 can include various other metals, individually, or in combination, which provide an energetic metallic fuel source, such as, for example, various alkaline metals, alkaline earth metals, transitional metals, actinides, lanthanides, poor metals, and others known to those skilled in the art. In an alternative embodiment of the present invention, the fuel charge 35 can be replaced with and/or include other energetic fuel sources, such as, for example, coke, coal, or coal billets. Note further, although described as a single unit, the fuel charge 35 can include a plurality of fuel charges 35 axially stacked within the charge holder body 61.

As perhaps best shown in FIG. 1, the supply apparatus 41 also can include an adjustable fuel charge linear feed assembly 49 located adjacent to and/or partially within one end of the charge holder assembly 43. The adjustable fuel charge linear feed assembly 49 includes piston positioned within the confines of the charge holder body 61. In the embodiment illustrated in FIGS. 1-2, the piston 50 is attached to a linear feed piston rod 71, extending, for example, through a rod receiving aperture 73 in the flange 63, which forms the proximal end of the charge holder assembly 43. The flange 63 can include an insulated packing seal assembly 75, which includes at least one, but preferably a plurality of annular recesses extending along an outer diameter of the rod receiving aperture 75 to receive a corresponding plurality of annular packing seals 77.

The linear feed assembly 49 also includes, for example, a DC, electric motor 81 or other suitable drive motor, kinematically associated with, for example, a worm gear 83, which rotates an associated worm nut (not shown) to thereby bring about the linear motion of a feed shaft 85, which can be rigidly attached to rod 71 of piston 50. To prevent piston 50 and piston rod 71 from cranking over, i.e., inadvertently over-extending piston 50 distally through the charge holder body 61 and into the fuel charge grinder assembly 45, described later, an embodiment of the supply apparatus 41 includes a pin 91 that is fixed on or otherwise connected to rod 71 so that the pin 91 moves along a groove 93 extending axially along a portion of the power frame 95 of the supply apparatus 41. In a preferred configuration, pin 91 actuates one or more limit switches 97, 99, positioned along the power frame 95 to restrain the linear motion of the rod 71 by turning off the power supply to electric motor 81, when in contact therewith.

In a preferred configuration, the power frame 95 carries a metal ruler 100, located on the side surface of groove 93, and positioned such that pin 91 serves as a moving pointer which functions to help the user to visually determine the position of the piston 50 and rod 71, to thereby determine the position and/or quantity remaining of the fuel charge 35 within the charge holder body 61.

The proximal-most flange 63 of the charge holder assembly 43 can include at least one, but preferably, a plurality of channels interfaced on an external surface with a corresponding number of connection fittings 101, 102, 103, 104. In a preferred configuration, there are at least four channels, with the channel 111 interfaced with fitting 101 supplying a carrying gas agent (which may be a non-oxidizing neutral gas) which travels through cavity 121, then through pathway 123, then through fuel charge inner bore 125, and to the proximal side of grinder 47, to carry ground fuel charge particles ground from the fuel charge 35 by grinder 47 through conduit 127 to the combustor 33. The channel interfaced with fitting 102, if so configured, can supply a neutral gas in order to create a non-oxidizing medium in the working volume of charge holder body 61. The fitting 103 can provide a receptacle to hook up a bypass line connecting the combustion apparatus 31 with the charge holder assembly 43 in order to dampen an overpressure, which may occur at the time of starting up the combustor 33. The fitting 104 and associated channel can be used to access an internal pressure associated with portions of the supply apparatus 41 to allow a user to take pressure measurements thereof.

Figure 3:
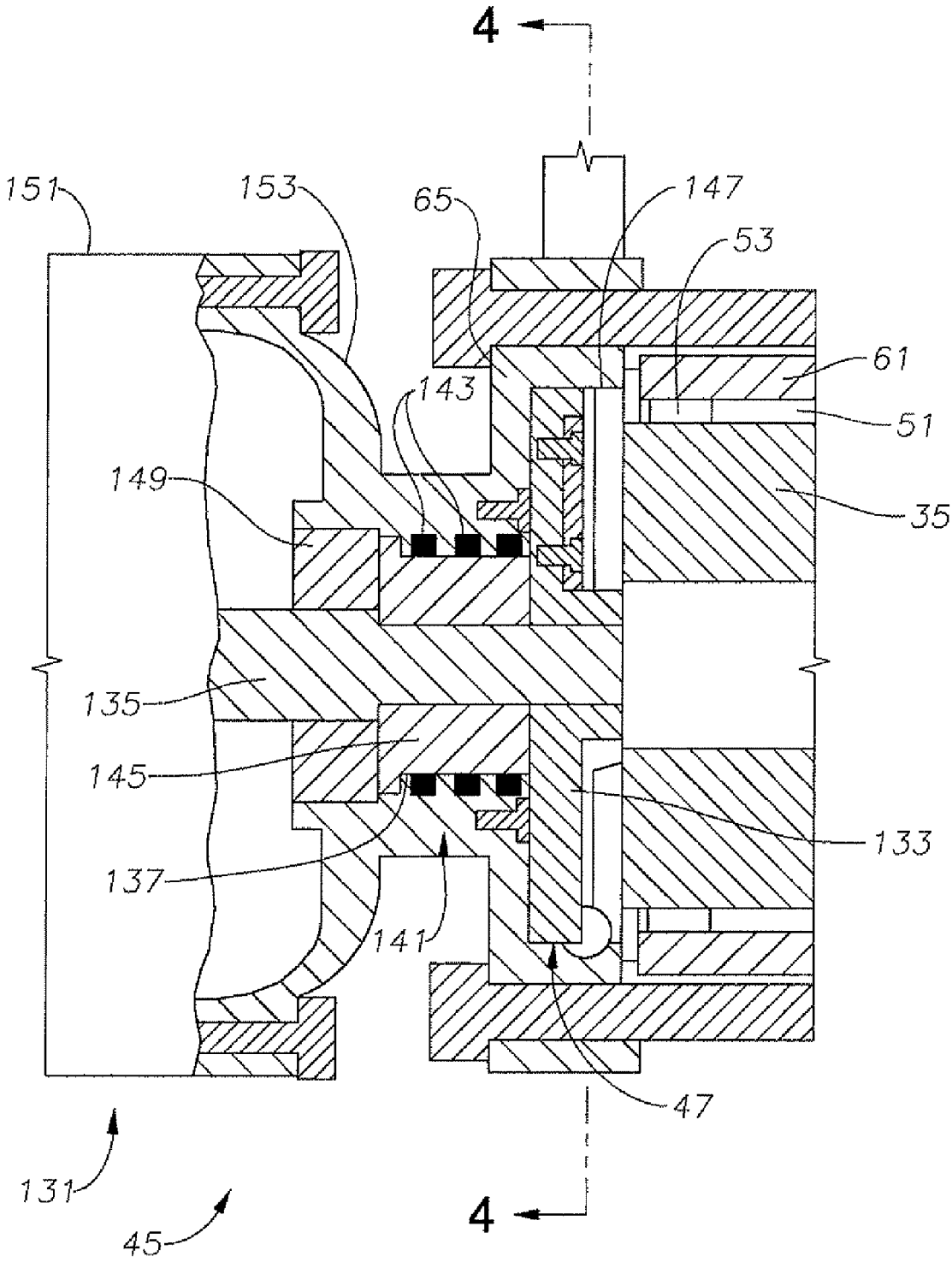
FIG. 3 is sectional view of a portion of a grinder assembly of the fuel supply apparatus shown in FIG. 1 according to an embodiment of the present invention.
Figure 4:
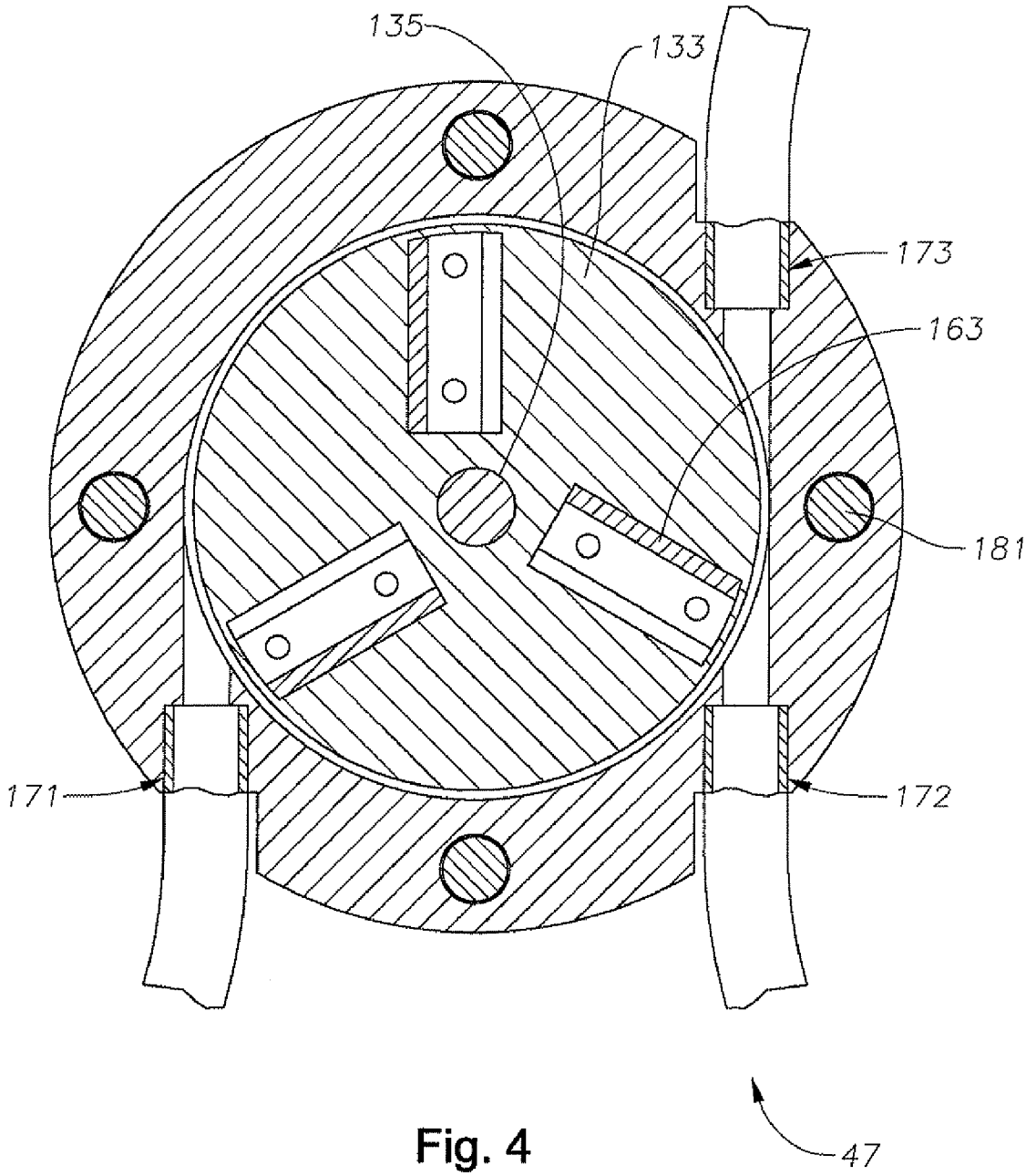
FIG. 4 is a sectional view of a grinder of the grinder assembly taken along the 4-4 line of FIG. 3 according to an embodiment of the present invention.

As perhaps best shown in FIGS. 3 and 4, the fuel supply apparatus 41 can include a mechanical fuel charge grinder assembly 45 enclosed by or otherwise interfaced with the fuel charge holder assembly 43 to grind the fuel charge 35 contained within the charge holder body 61. According to the exemplary embodiment of the present invention, the mechanical fuel charge grinder assembly 45 includes a mechanical mill drive motor assembly (mill drive) 131 interfaced with a mechanical fuel charge grinder 47 positioned adjacent the distal end of the charge holder body 61 to receive and grind portions of the fuel charge 35 extended into the grinder 47 by the fuel charge linear feed assembly 49. As perhaps best shown in FIG. 4, the mechanical fuel charge grinder 47 can include a three-bladed face mill 133 carried by a portion of shaft 135 extending through a shaft receiving aperture 137 in the flange 65. The flange 65 can include an insulated packing seal assembly 141, which include at least one, but preferably a plurality of, annular recesses extending along an outer diameter of the shaft receiving aperture 137 to receive a corresponding plurality of packing seals 143. The packing seals 143 seal off the portion 145 of the mill drive 161 adjacent the grinding chamber 147 enclosing the mill 133 and receiving shaft 135 and the portion 149 of the mill drive 131 so that ground fuel does not exit the grinding chamber 147 or charge holder body 61 into motor 151 through the front cover 153. Note, in the illustrated configuration, flange 65 is integrated with the front cover 153 of the electric motor 151 positioned along an axial extent of the mechanical fuel charge grinder assembly 45.

Figure 5:
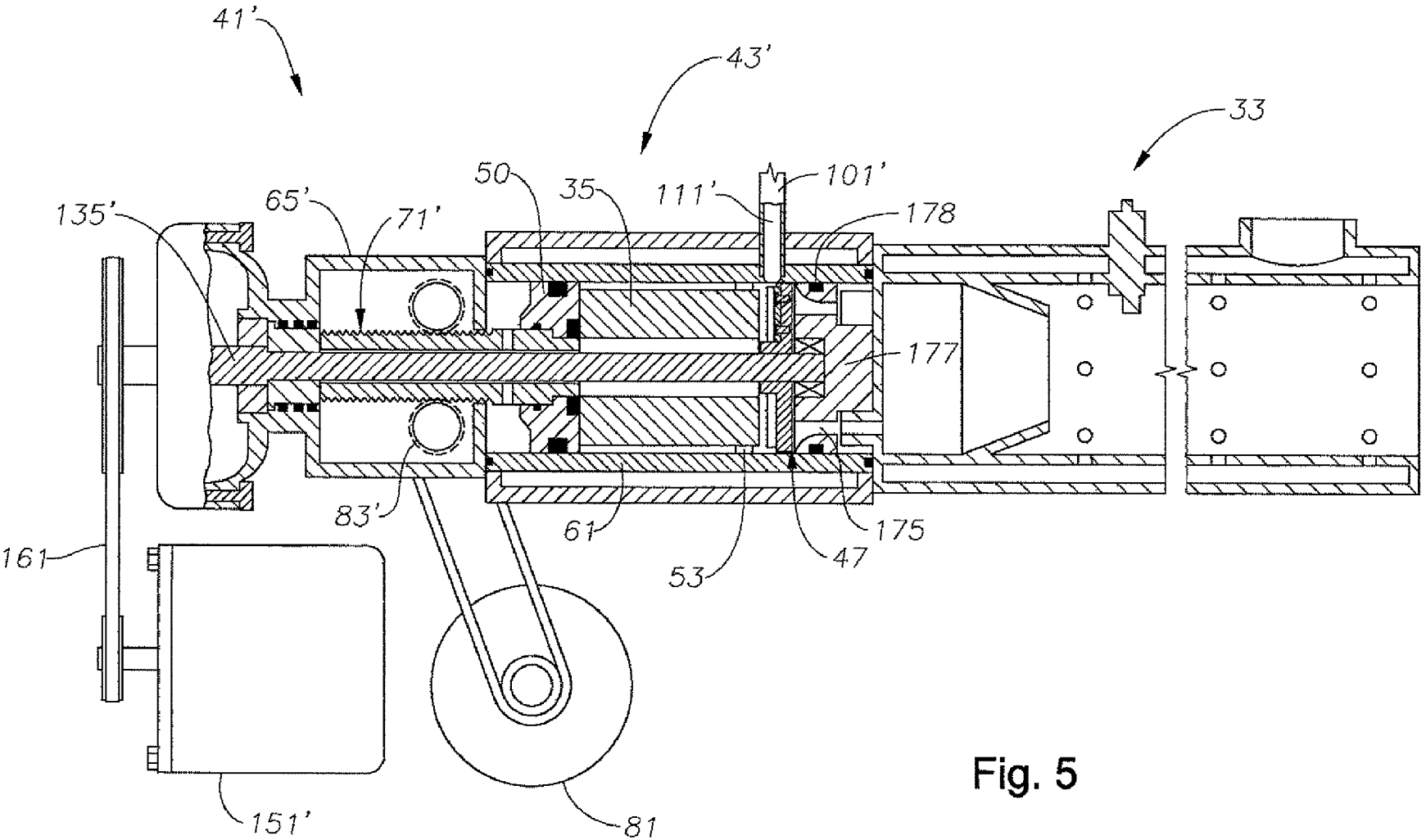
FIG. 5 is a schematic sectional view of a system for combustion of a fuel including a fuel supply apparatus and a combustion apparatus according to an embodiment of the present invention.

As shown in FIG. 5, in another configuration, the drive motor 151' is offset and a drive belt 161, drive chain, or other transmission device known to those skilled in the art, is used to drive the drive shaft 135', and thus, mill 133'.

In both the fuel supply apparatus 41 configured as shown in FIG. 1 and in the fuel supply apparatus 41' as shown in FIG. 5, grinding of the fuel charge 35 is performed by the cutting blades 163 (FIG. 4) of mill 133 within the grinding chamber 147 (FIG. 3) connected by channel 111, 111' with the carrier agent hook up fitting 101, 101', and/or a separate neutral gas hook up fitting 102 connected to its associated channel, to thereby provide a pressurized delivery of ground, e.g., metal, fuel to the combustor 33. That is, fine solid fuel particles coming off the end of the fuel charge 35 are carried out by the flow of the carrier agent, or carrier gas/fluid, from the grinding chamber 147 via fittings 171, 172, 173 as shown in FIG. 4, or directly through conduits/annulus 175 as shown in FIG. 5. The carrier gas/fluid may be, for example, air, oxygen, water vapor, or combinations thereof. More preferably, the carrier gas/fluid is a neutral gas such as nitrogen, carbon dioxide, a noble gas, or combinations thereof or others known to those skilled in the art, which will function to minimize the formation of an oxide layer around the ground particles prior to combustion in the combustor 33.

In the embodiment illustrated an FIGS. 1-4, having, e.g., three fittings 171, 172, 173, the apparatus 41 can supplying fuel to one or several metal combustors 33 which can be hooked up via connection fittings 171, 172, 173, by branch pipes with, e.g., an inner diameter of 5 to 10 mm and, e.g., connection thread M 16×1.5. That is, a separate supply line 127 (FIGS. 1 and 2) can be connected to each of the fittings 171, 172, 173, to supply ground fuel particles to up to three clients or combustors 33. Note, when servicing several clients or several combustors 33, it is generally preferred to maintain equal flow resistance of supply lines 127. When the supply apparatus 41 is to serve only one client or supply fuel to only one combustor 33, fittings 172 and 173 are normally plugged. Alternatively, when the supply apparatus is to serve only one client or supply fuel to only one combustor 33, the ground fuel from one or more of the fittings 171, 172, 173, can be channeled through an conduit/annulus 175 between the fuel charge holder body 61 and the proximal drive shaft support 177, as shown in FIG. 5. The drive shaft support 177 can include at least one annular recess extending along an outer diameter of the drive shaft support 177 to receive an annular seal 178 positioned to dampen vibrations between the drive shaft support 177 and the fuel charge holder body 61.

In the embodiment of the charge holder assembly 43 illustrated in FIG. 1, the flanges 63, 65, and charge holder body 61 are tightened by fasteners (e.g., pins) 181 (see, e.g. FIG. 2) to enhance the integrity of the fuel charge holder assembly 43. Further, as noted previously, a plurality of lock pins 53 can be arranged along the inner surface of the charge holder body 61 immediately adjacent to the flange 65 in order to lock fuel charge 35 within the charge holder body 61. Note, in the embodiment of the fuel charge holder assembly 43, shown in FIG. 5, lock pins 53 can be arranged along the inner surface of the charge holder body 61 immediately adjacent to the proximal shaft support 177 in order to lock fuel charge 35 within the charge holder body 61. In this embodiment of the fuel supply apparatus 41', shaft 135' extends through flange assembly 65', which can be configured similar to that described with respect to FIG. 3.

The supply apparatus 41, 41', are designed for storing and crushing the metal or other fuel charges 35 that have been, for example, pre-pressed from, e.g., powdered fuel of the required chemical composition, having a pre-assigned or selected particle size and packing density, with subsequent conveyance of the particles by a gas carrier into the combustor 33. In embodiments of the fuel supply apparatus 41, 41', the supply apparatus typically has the following technical specifications:

| | |
|---|---|
| metal fuel charge diameter | 100 mm; |
| metal fuel charge length, max. | 150 mm; |
| gas carrier allowable pressure, max. | 4 MPa; |
| gas carrier flow rate (% of solid fuel per second consumption) | 15-20% |
| linear charge travel speed in the fuel tank | 1-5 mm/s |
| weight, max. | 30 kg |
| dimensions | 1000 × 250 × 250 mm |
| mean time between failures, min. | 6 hours |
| specified life, min. | 15 hours |

The consumption rate of the fuel charge 35 can be adjusted by way of adjusting the linear speed of charge motion of the fuel charge 35 in the charge holder body 61. Changing the linear speed of piston 50, and thus, the linear motion (speed) of fuel charge 35 can be through use of the principle of adjusting revolutions of the electric motor 81, via the worm gear 83 (see, e.g., FIG. 1), which moves the feed shaft 85 which, in a preferred configuration, is rigidly attached to the displacement (linear feed) piston rod 71, or through one or more gears 83' (see, e.g., FIG. 5), which can directly move linear feed piston rod 71'. The motor 81 can have a nominal rotational speed of, e.g., n=3000 rpm. According to the exemplary configuration, the gear 83, 83', have a reduction ratio of, e.g., k=32. Also according to the exemplary configuration, the linear speed of fuel charge 35 in the charge holder body 61 is maintained within, for example, 1 to 5 mm/s, according to fuel consumption requirements.

In embodiments of the grinder 47, the three-blade face mill 133 that grinds the fuel charge 35 is driven with motor 151, 151', which, according to a preferred configuration, is a 600 W three-phase induction motor with a nominal rotational speed of n=3000 rpm. Note, however, other types of AC or DC motors are within the scope of the present invention. Additionally, according to a preferred configuration, the rotational direction of the shaft 135, 135', is clockwise (when viewed from the cutter side).

As will be readily appreciated by those skilled in the art, the per-second consumption of the fuel charge 35 depends on the physical parameters of the fuel charge 35 being used; particularly on the specific weight of the particles and on the dispersion fuel particles fuel charge fill-in coefficient; and has a linear dependency upon the linear speed of the feed piston 50.

Figure 6:
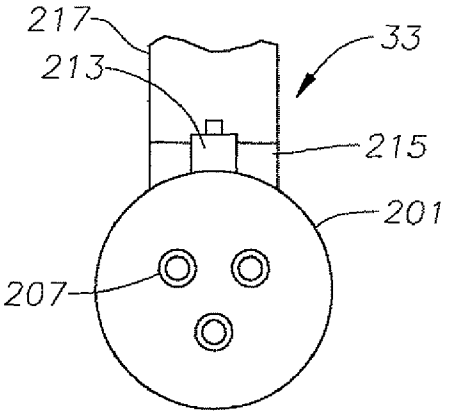
FIG. 6 is a side schematic sectional view of a fuel combustion apparatus according to an embodiment of the present invention.
Figure 7:
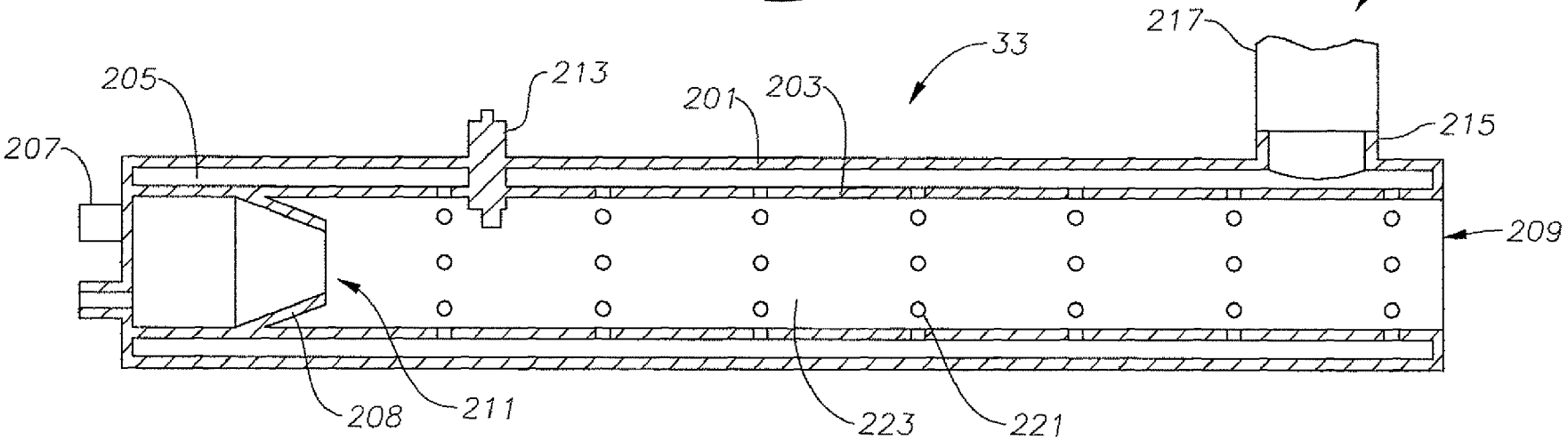
FIG. 7 is a schematic sectional view of the fuel combustion apparatus taken along line 7-7 line in FIG. 6 according to an embodiment of the present invention.
Figure 8:
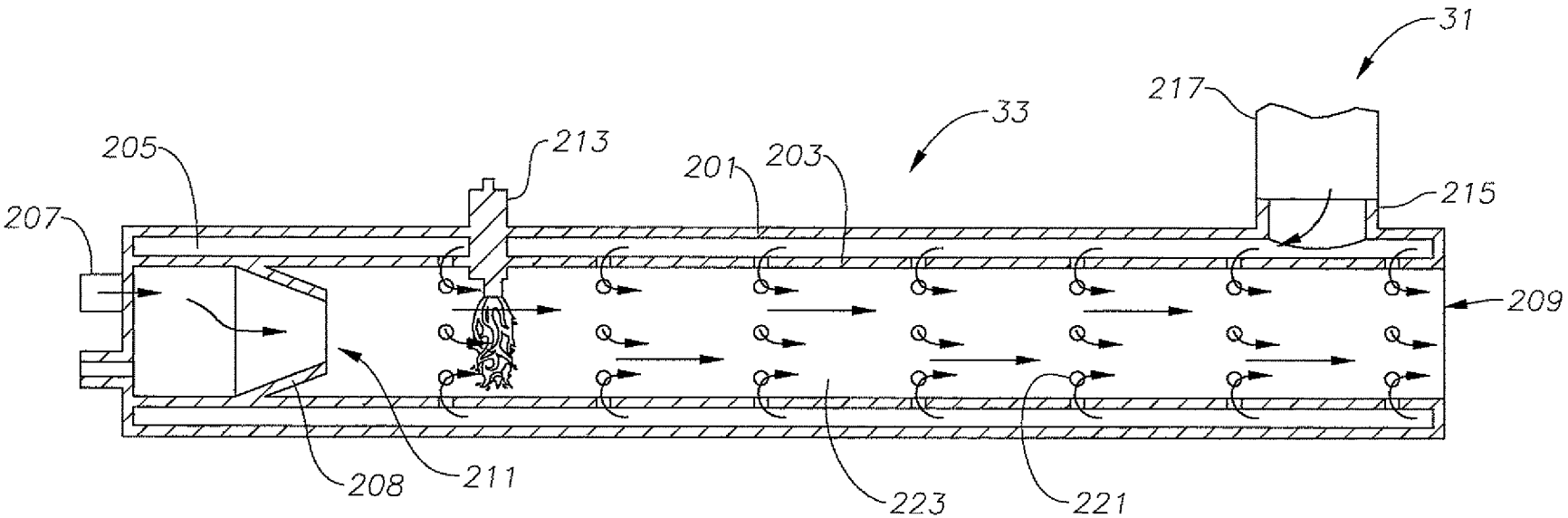
FIG. 8 is a schematic sectional view of the fuel combustion apparatus of FIG. 7 illustrating operation thereof according to an embodiment of the present invention.

As perhaps best illustrated in FIGS. 6-8, the fuel combustion apparatus 31 includes a combustor 33 having an outer sidewall or outer tubular member 201. The outer tubular member 201 substantially encloses an inner sidewall or inner tubular member 203, thereby defining an annulus 205 therebetween. The inner surface of the inner tubular member 203, in turn, describes a working or combustion chamber 223 in which the combustion of the metal fuel occurs. A working fluid or fuel inlet 207 extends through a closed first end of the combustor 33 to receive a working fluid generally composed of the ground (pulverized) metal fuel (typically ground from a fuel charge 35), along with the carrier gas/fluid agent used to carry the particles to the inlet 207. Correspondingly, a working fluid outlet or exhaust 209 is located at an open end of the combustor 33. The ground fuel particles and the carrier gas/fluid agent from the fuel supply apparatus 41, 41', enter the combustion chamber 223 through fuel inlet 207 for combustion.

According to the exemplary embodiment of the fuel combustion apparatus 31, a nozzle region 211 is formed within the inner tubular member 203 by inclined walls 208 extending axially away from the closed first end, and both radially and axially inward. In an alternative embodiment of an injector nozzle, a separate fitting (not shown) having a cylindrical-conical shape can be positioned within inner tubular member 203 as would be understood by those skilled in the art.

An igniter 213 is positioned axially downstream from nozzle region 211, within inner tubular member 203 for igniting the ground fuel particles received from the supply apparatus 41, 41' and carried by the carrier fluid. Igniter 213 may be a propane torch or other appropriate source of ignition as understood by those skilled in the art, such as, for example, an electrode providing an electrical arc or spark. Regardless of the configuration, the igniter 213 can include a temperature sensitive retraction mechanism as would be understood by those skilled in the art configured to substantially retract major portions of the igniter from within the combustion chamber 223 once the temperature within the chamber reaches a preselected temperature.

As will be readily appreciated by those skilled in the art, the nozzle region 211 can focus the flow of the ground fuel particles and the carrier gas/fluid agent through the inner tubular member 203, such that the velocity of the fuel particles and carrier gas/fluid increases and is more compact when reaching igniter 213. The combusted fuel particles and carrier gas/fluid exit combustion chamber 223 through exhaust 209 after combustion within the inner tubular member 203.

As perhaps best shown in FIGS. 7-8, one or more cooling fluid inlets 215, adapted to be connected to a supply line 217 or fluid capturing dam (not shown), is formed through the outer tubular member 201, which opens into annulus 205. In a configuration of the cooling fluid inlet 215, the size of the cooling fluid inlet 215 can be adjusted to control cooling fluid pressure, and thus, cooling fluid mass flow rate. In addition to adjusting the size of the orifice of the inlet 215, pressure in the supply line 217 can be controlled, for example, by a controller (not shown) as would be understood by one skilled in the art. Note, although cooling inlet 215 is shown positioned near exhaust 209, such cooling inlet can be positioned in alternative locations along the length of outer tube 201.

Annulus 205 carries a cooling fluid from the cooling fluid inlet 215 along the outer periphery of the inner tubular member 203 to at least one cooling fluid outlet 221 extending through inner tubular member 203, to allow the injection of the cooling fluid from within the annulus 205 and then within the inner tubular member 203. Beneficially, the cooling fluid has multiple functions. In the annulus 205, the cooling fluid enhances cooling of the inner tube 203. In the combustion chamber 223, it both enhances cooling the inner tube 203, particularly during passage therethrough, and provides an oxidizing source to support combustion of the combustible fuel particles Note, additionally or alternatively, cooling fans or ribs (not shown) extending from inner tube 203 can extend into annulus 205 to enhance sinking heat from the inner tube 203.

In a preferred configuration of the combustor 33, a plurality of cooling fluid outlets 221 extend through inner tubular member 203 to inject the cooling fluid into the flow of the fuel particles and carrier gas/fluid being combusted/to be combusted within combustion chamber 223. As noted above, besides cooling inner tubular member 203, the cooling fluid can act as an oxidizer that supports combustion of the fuel particles within combustion chamber 223. Correspondingly, the cooling/oxidizing fluid may be, for example, air, oxygen, water vapor, seawater, or other suitable fluids. In the case of water vapor, water may be introduced through cooling fluid inlet 215 as liquid water or steam, which would become dissociated water vapor when exposed to high temperatures within combustion chamber 223.

In operation, as perhaps best shown in FIGS. 1 and 5, a fuel charge 35 is positioned within a fuel charge holder body 61 and is engaged by a piston 50. A drive motor 151, 151', is powered to begin rotating grinder 47 via rotatable driveshaft 135, 135'. A motor 81 is selectively powered at a selected speed to begin a linear advancement of the piston 50, and thus, linear advancement of the fuel charge 35 into blades 163 of mill 133 of grinder 47. Further, as the fuel charge 35 is being ground pulverized) by grinder 47, i.e., returned to art form, a carrier agent is supplied under pressure to grinder chamber 147 (FIG. 3) via channel 111, 111', to thereby carry fuel particles ground from the fuel charge 35 through a conduit such as, for example, tube/supply line 127 or conduit/annulus 175 to the inlet 207 of one or more combustor 33. Beneficially, using aluminum as an example metal fuel, the fuel charge 35 can comprise pulverized aluminum particles compressed to form the fuel charge 35 to have a particle density of upwards of 60%-70%. Also beneficially, the aluminum particles can have a relatively thin coating of aluminum oxide analogies to that of an eggshell surrounding an egg. As the grinder 47 grinds the fuel charge 35, at least portions of the aluminum oxide layer/coating are fractured/remove, exposing the aluminum particle core (non-oxidized aluminum). I.e., removal of the aluminum oxide layer allows for direct access by an oxidizer to the aluminum formerly encased by the aluminum oxide layer. Hence, in the preferred configuration, the carrying agent is a neutral fluid which inhibits oxidation until the time when the aluminum particles are delivered inside the combustion chamber 223 where the cooling fluid provides for oxidation of the aluminum, under ignition conditions having a much lower heat requirement that was required by the state of the art to melt the aluminum oxide.

As also shown in FIG. 8, after being ground, the carrier agent then carries the ground aluminum particles out of the grinding chamber 147 and into the combustion chamber 223, through inlet 207 of the combustor 33 and through nozzle region 211 where the particles are concentrated and ignited by the igniter 213 in the presence of the oxygen carrying cooling fluid. Note, during testing, utilizing a 7.5 g/s flowrate of aluminum particles, using propane as the ignition source of igniter 213, and using air as the cooling fluid, a cooling air flow rate of 15-20% of that of the aluminum flow rate was found to be adequate. Note also, during such testing, the reaction zone resulting from the combustion within the combustion chamber 223 included a length extending in excess of 20 calibers in the axial direction past the end of the combustor exhaust 209 with a width of the reaction zone being about 10 calibers, and a temperature approaching approximately 10,000° C. The reaction zone was also found to be both stable to flow and temperature disturbances.

Beneficially, such reaction zone can be readily utilized, for example, for the thermal destruction of hazardous materials or other uses known to those skilled in the art, including propulsion, for example. Further, for the destruction of a large volume of hazardous material or for other heating or propulsion requirements, multiple combustors can be supplied fuel either by a single fuel supply apparatus or by multiple fuel supply apparatus each servicing one or more combustor 33.

Also beneficially, due to the small size of the aluminum particles and the ready access by the oxidizer, e.g., oxygen, in the cooling fluid, the resulting exhaust stream not only provides necessary operational characteristics, e.g., propulsion and/or heat, but a potentially commercially valuable exhaust product—high-grade aluminum oxide.

This non-provisional application is related to U.S. Patent Application No. 60/833,175, filed on Jul. 25, 2006, titled "System, Apparatus and Method for Combustion of Metals," incorporated herein by reference in its entirety.

In the drawings and specification, there have been disclosed a typical preferred embodiment of the invention, and although specific terms are employed, the terms are used in a descriptive sense only and not for purposes of limitation, The invention has been described in considerable detail with specific reference to these illustrated embodiments. It will be apparent, however, that various modifications and changes can be made within the spirit and scope of the invention as described in the foregoing specification. For example, although the description primarily focuses on metal fuel charges containing pulverized metal fuel particles, as noted previously, other non-metal fuels can be utilized in both the fuel supply apparatus and the combustion apparatus, separately, or in combination. Also, for example, the combustor can include a stationery or divertible exhaust nozzle to provide acceleration and directional control of exhausted fuel to enhance propulsion, when so employed. Further, for example, the system can include a controller for controlling grinding speed of the grinder, the strength of the ignition source, and/or the amount of cooling fluid entering the annulus between the inner and outer combustor tubes.

The invention claimed is:

1. A metal combustion device, comprising:

a central chamber;

a side wall surrounding the central chamber, the distance between at least a portion of said side wall and said central chamber increasing from the periphery with respect to radial distance;

a working fluid inlet means to receive a combustible working fluid;

a working fluid outlet means positioned adjacent said working fluid inlet means to discharge combusted working fluid;

a cooling fluid inlet means to receive cooling fluid through an annulus between said side wall and said central chamber;

a cooling fluid outlet means to discharge said cooling fluid from said annulus between said side wall and said central chamber and mix it with said combustible working fluid to produce a combustible fuel mixture;

a fuel ignition means to ignite said combustible fuel mixture to produce said heated working fluid;

a metal fuel charge holder assembly positioned to hold and store the metal fuel charge;

a mechanical grinder positioned within the metal fuel charge holder assembly and comprising face mill including a plurality of blades which turn on a rotating shaft to pulverize said metal fuel charge positioned within said metal fuel charge holder assembly when the metal fuel charge is placed in direct contact with said mechanical grinder to thereby generate a combustible metal fuel from said metal fuel charge within said metal fuel charge holder assembly; and a metal fuel charge positioner within said metal fuel charge holder assembly and positioned to hold said metal fuel charge in direct contact with said mechanical grinder.

2. A system for combustion of a metal fuel, comprising:

a combustion apparatus comprising a combustor having a combustion chamber in which a metal fuel is combusted, the combustor including:

a closed end portion having a metal fuel inlet extending therethrough to receive the metal fuel, an open end portion having an open end defining a combustion chamber exhaust through which combusted metal fuel exits, an inner tubular member having an inner tubular member main body substantially extending between the closed end portion and the open end portion to form the combustion chamber in which the combustion of the metal fuel occurs, the inner tubular member main body having a plurality of apertures extending therethrough each defining a cooling fluid outlet positioned to allow the cooling fluid to enter the combustion chamber to thereby enhance inner tubular member cooling and oxidation of the metal fuel, an outer tubular member substantially surrounding the inner tubular member to substantially enclose the inner tubular member, and having an outer tubular member main body extending between the closed end portion and the open end portion to form a cooling fluid annulus between the inner tubular member main body and the outer tubular member main body, the outer tubular member also having an aperture extending therethrough to define a cooling fluid inlet to receive the cooling fluid, and an igniter located at least partially within the inner tubular member and positioned to ignite the metal fuel in the combustion chamber adjacent the metal fuel inlet in the closed end portion of the combustor; and a fuel supply apparatus positioned to communicate the metal fuel to the metal fuel inlet of the combustor, the fuel supply apparatus including:

a metal fuel charge holder assembly including a metal fuel charge holder body axially bounded on either end to substantially enclose the metal fuel charge holder body to thereby contain a metal fuel charge, a carrier gas inlet positioned to receive a carrier gas which carries the particles of metal fuel ground from the metal fuel charge to the metal fuel inlet of the combustor, a carrier gas outlet positioned to receive the carrier gas and particles of metal fuel carried by the carrier gas, and a pair of oppositely positioned end flanges, a first end flange of the pair of oppositely positioned end flanges closing a first end of a tubular shaped portion of the metal fuel charge holder body adjacent a grinder of a grinder assembly, and a second end flange of the pair of oppositely positioned end flanges closing a second end of the tubular shaped portion of the metal fuel charge holder body adjacent a metal fuel feed assembly, the metal fuel charge holder assembly further including at least one seal positioned in contact with the first end flange to sealingly engage an outer periphery of a portion of the grinder assembly so that the carrier gas and the particles of ground metal fuel do not communicate to a grinder motor through the first end of the tubular portion of the metal fuel charge holder body, and at least one seal positioned in contact with the second flange to sealingly engage an outer periphery of the piston rod so that the carrier gas and the particles of ground metal fuel do not exit the metal fuel charge holder assembly through the second end of the tubular portion of the metal fuel charge holder body, the grinder assembly including the grinder, a rotatable grinder shaft connected to the grinder, and the grinder motor positioned to rotate the grinder shaft, the grinder positioned to rotatably grind an end of the metal fuel charge to generate the particles of metal fuel to be conveyed to the combustion chamber through the carrier gas outlet; and comprising a mill fixedly secured to the grinder shaft to rotate therewith, the mill having a blade positioned thereon for engaging the metal fuel charge as the mill rotates, the grinder shaft extending from the mill through the first end flange of the metal fuel charge holder assembly to connect to the grinder motor, and the metal fuel feed assembly including a piston located within the metal fuel charge holder assembly, a linear piston rod engaging the piston, a feed motor to selectively feed portions of the metal fuel charge into the grinder, and a drive train connected between the feed motor and the piston rod and including a feed shaft positioned to engage a portion of the piston rod extending from the piston through the second end flange and connected to a gear that translates rotational movement associated with the feed motor to linear movement of the piston so that when the feed motor is operating; the feed motor actuates the piston rod and piston to bias the metal fuel charge toward the grinder.

3. A system as defined in claim 2, wherein the plurality of cooling fluid outlets extend along a substantial portion of the inner tubular member;

wherein the annulus carries the cooling fluid from the cooling fluid inlet along an outer periphery of the substantial portion of the inner tubular member; and wherein the cooling fluid entering the cooling fluid inlet includes one of the following: air, gaseous oxygen, seawater, or liquid water.

4. A system as defined in claim 2, wherein the metal fuel feed assembly further includes:

a pin extending from the feed shaft; and a limit switch positioned so that the pin engages the limit switch when the feed shaft is in a predetermined location, the limit switch being in electrical communication with the feed motor so that the limit switch causes the feed motor to cease operating when the pin engages the limit switch.

5. A system as defined in claim 4, wherein the feed motor is a variable speed motor that can rotate in a first direction that causes the feed shaft to push the piston and piston rod toward the grinder and a second direction that causes the feed shaft to pull the piston and piston rod away from the grinder; and wherein the limit switch comprises a pair of spaced-apart switches, one of the pair of switches positioned to engage the pin when the piston is adjacent the grinder and the other of the pair of switches positioned to engage the pin when the piston is in position for the metal fuel charge holder assembly to receive the metal fuel charge, thereby reducing damage to the metal fuel charge holder assembly due to the feed motor over-driving the feed shaft in when pushing and pulling the piston rod.

6. A system for combustion of a metal fuel, comprising:

a combustion apparatus comprising a combustor having a combustion chamber in which a metal fuel is combusted, the combustor including:

a closed end portion having a metal fuel inlet extending therethrough to receive the metal fuel, an open end portion having an open end defining a combustion chamber exhaust through which combusted metal fuel exits, an inner tubular member having an inner tubular member main body substantially extending between the closed end portion and the open end portion to form the combustion chamber in which the combustion of the metal fuel occurs, the inner tubular member main body having a plurality of apertures extending therethrough each defining a cooling fluid outlet positioned to allow the cooling fluid to enter the combustion chamber to thereby enhance inner tubular member cooling and oxidation of the metal fuel, an outer tubular member substantially surrounding the inner tubular member to substantially enclose the inner tubular member, and having an outer tubular member main body extending between the closed end portion and the open end portion to form a cooling fluid annulus between the inner tubular member main body and the outer tubular member main body, the outer tubular member also having an aperture extending therethrough to define a cooling fluid inlet to receive the cooling fluid, and an igniter located at least partially within the inner tubular member and positioned to ignite the metal fuel in the combustion chamber adjacent the metal fuel inlet in the closed end portion of the combustor; and a fuel supply apparatus positioned to communicate the metal fuel to the metal fuel inlet of the combustor, the fuel supply apparatus including:

a metal fuel charge holder assembly including a metal fuel charge holder body axially bounded on either end to substantially enclose the metal fuel charge holder body to thereby contain a metal fuel charge, a carrier gas inlet positioned to receive a carrier gas which carries the particles of metal fuel ground from the metal fuel charge to the metal fuel inlet of the combustor, a carrier gas outlet positioned to receive the carrier gas and particles of metal fuel carried by the carrier gas, a first end flange positioned to close a first end of a tubular portion of the metal fuel charge holder body adjacent a metal fuel feed assembly, a second end drive shaft support at least partially closing a second end of the tubular portion of the metal fuel charge holder body adjacent a grinder of a grinder assembly and positioned to support a rotatable grinder shaft, and at least one seal positioned in contact with the first end flange to sealingly engage a portion of the grinder assembly so that the carrier gas and the particles of ground metal fuel do not exit the metal fuel charge holder assembly through the first end of the tubular portion of the metal fuel charge holder body; and the grinder assembly including the grinder, the rotatable grinder shall connected to the grinder, and a grinder motor positioned to rotate the grinder shaft, the grinder positioned to rotatably grind an end of the metal fuel charge to generate the particles of metal fuel to be conveyed to the combustion chamber through the carrier gas outlet and comprising a mill fixedly secured to the grinder shaft to rotate therewith, the mill having a blade positioned thereon for engaging the metal fuel charge as the mill rotates, the grinder shaft extending from the mill through the piston rod and through the first end flange to operatively connect to the grinder motor; and the metal fuel feed assembly including a piston located within the metal fuel charge holder assembly, a linear piston rod engaging the piston, a feed motor to selectively feed portions of the metal fuel charge into the grinder, and a drive train connected between the feed motor and the piston rod and including a feed shaft positioned to engage a portion of the piston rod and connected to a gear that translates rotational movement associated with the feed motor to linear movement of the piston so that when the feed motor is operating, the feed motor actuates the piston rod and piston to bias the metal fuel charge toward the grinder.

7. A system as defined in claim 6, wherein the plurality of cooling fluid outlets extend along a substantial portion of the inner tubular member;

wherein the annulus carries the cooling fluid from the cooling fluid inlet along an outer periphery of the substantial portion of the inner tubular member; and wherein the cooling fluid entering the cooling fluid inlet includes one of the following: air, gaseous oxygen, seawater, or liquid water.

* * * * *

UNITED STATES PATENT AND TRADEMARK OFFICE

CERTIFICATE OF CORRECTION

PATENT NO. : 7,739,968 B2
APPLICATION NO. : 11/828188
DATED : June 22, 2010
INVENTOR(S) : Borissov et al.

It is certified that error appears in the above-identified patent and that said Letters Patent is hereby corrected as shown below:

Front Cover:

Item (60) Related U.S. Application Data: the correct information is -- Provisional application No. 60/833,175, filed on July 25, 2006. --

Signed and Sealed this

Ninth Day of November, 2010

David J. Kappos

David J. Kappos
*Director of the United States Patent and Trademark Office*